United States Patent [19]

Halff et al.

[11] Patent Number: 4,903,560

[45] Date of Patent: Feb. 27, 1990

[54] PUNCHING DEVICES

[75] Inventors: Albert Halff, Jüchen; Manfred Vossen, Niederkrüchten, both of Fed. Rep. of Germany

[73] Assignee: Bobst S.A.

[21] Appl. No.: 194,443

[22] Filed: May 16, 1988

Related U.S. Application Data

[62] Division of Ser. No. 935,408, Nov. 26, 1986, Pat. No. 4,763,551, which is a division of Ser. No. 609,004, May 10, 1984, abandoned, which is a division of Ser. No. 322,541, Nov. 18, 1981, Pat. No. 4,485,708.

[30] Foreign Application Priority Data

Nov. 24, 1980 [DE] Fed. Rep. of Germany ..... 3044083

[51] Int. Cl.[4] ..... B26D 7/06; B26F 1/40

[52] U.S. Cl. ..... 83/277; 83/530; 83/624; 83/628

[58] Field of Search ..... 83/277, 616, 624, 627, 83/628, 630, 613; 72/456, 451, 452; 100/272, 280, 291, 292, 257

[56] References Cited

U.S. PATENT DOCUMENTS

| | | | |
|---|---|---|---|
| 1,007,792 | 11/1911 | Orton | 83/630 |
| 1,749,545 | 3/1930 | Pierce | 83/630 |
| 2,507,556 | 5/1950 | Bobst | 83/630 |
| 3,678,792 | 7/1972 | Dvorak | 83/627 |

FOREIGN PATENT DOCUMENTS

| | | | |
|---|---|---|---|
| 690442 | 7/1964 | Canada | 83/628 |
| 942554 | 5/1956 | Fed. Rep. of Germany | 83/630 |

*Primary Examiner*—Hien H. Phan

*Attorney, Agent, or Firm*—Jones, Day, Reavis & Pogue

[57] ABSTRACT

A punching device for automatic punching machines for the punching of paper, cardboard and the like, comprising: a driving mechanism for a top shoe; such as a rocking lever drive, elliptical cam drive, or wedge-form transmission; a stationary bottom shoe supporting a counter-punch; a movable top shoe supporting punch knives; and a gripper bar arrangement for intermittent forwarding through the punching device of sheets to be punched wherein the drive mechanism for the top shoe is located between the top shoe and a yoke which is connected with the bottom shoe through prestressed tie rods.

14 Claims, 5 Drawing Sheets

PUNCHING DEVICES

This is a division of application Ser. No. 935,408, filed 11/26/86, which in turn is a division of Ser. No. 609,004, filed May 10, 1984, now abandoned, which in turn is a division of Ser. No. 322,541, filed Nov. 18, 1981, now U.S. Pat. No. 4,485,708.

The invention relates to a punching device for automatic punching machines for punching sheets of paper, cardboard and the like, with a bottom shoe and a top shoe, one shoe supporting the punch knives and the other shoe the counter-punch, one shoe being fixed and the other shoe being moveable to and fro normal to the plane of the counter-punch by a drive mechanism, and with a gripper bar arrangement for the intermittant forwarding through the punching device the sheets to be punched.

Punching devices of this kind have been employed for some considerable time. These known punching devices are driven either by a toggle drive or an eccentric drive.

Both systems have their respective advantages and disadvantages. For example, the toggle drive offers a high punching pressure with relatively low power requirement, and it also produces a relatively "soft" punching impact which diminishes the development of noise. A disadvantage of the toggle drive is, of course, the relatively short "open time", that is to say the time during a working cycle of the machine in which the gripper bars are able to forward the sheet between the open shoes. Due to this short "open" period the punched sheet must be subjected to considerable acceleration and deceleration forces so that the maximum working speed is relatively low.

A further disadvantage is the relatively complicated structure of the system.

On the other hand, the eccentric drive system, which has been employed for many decades in its automatic punching machines by the WUPA firm, is of a much simpler construction and offers a much longer "open" time at the shoes, so that a relatively long period of time remains for the forwarding of the pick-up carriage between the open shoes, whereby the acceleration forces are reduced and thereby higher operating speeds can be obtained.

However, disadvantageous are the necessarily high power requirement and also the "hard" punching impact, which necessitates relatively expensive anti-vibration measures.

Further characteristic differences between the two drive systems result from the fact that, in the known toggle drive, the bottom shoe is manipulated and carries the steel platen, whilst the stationary top shoe carries the punch knives, so that, during the punching operation, the sheets lying on the platen are pressed upwards against the punch knives. The advantage of this arrangement is the light weight of the displaced shoe, which occasions the lower power requirement already mentioned. Of course, the moving bottom shoe increases the risk of sheets being torn.

In the case of the known eccentric drive on the other hand, the top shoe is actuated and is pressed against the bottom shoe which is firmly screwed to the machine frame. Here also, the punching die means is on the top shoe and the (hardened and ground) steel platen is on the bottom shoe.

The eccentric drive results from the top shoe being provided with two outwardly-projecting shoulders to each of which are articulated at each side two tie rods which extend downwards and are there moved up and down by two eccentric shafts. Due to the two outwardly-disposed hinges, the top shoe extends over a relatively large area, so that, because of the required bending strength, a relatively heavy frame construction is required for top shoe. This again adds quite considerably to the weight of the top shoe and leads to the aforementioned higher power requirement.

The fact that the better shoe is stationary in this form of construction, has the great advantage that there results a smooth and stable-forwarding plane for the sheet, so that the risk of tearing of the sheet is considerably less. Moreover, where the bottom shoe is stationary, the sheet need not longer be subjected to an additional vertical movement which would adversely affect the accuracy of punching. Also, the progression of material from the input station to the punching station and from the punching station to the following break-away station, is essentially without problems when the bottom shoe bed is stationary.

Instead of activating the top shoe by means of an eccentric drive and eccentric shafts, this can, of course, also be done with a toggle drive located between the bottom and top shoes, whereby the advantages of the stationary bottom shoe are retained, while obtaining a softer punching impact, although again with the disadvantage of the shortened rest periods.

All attempts at a solution with a moving top shoe, whether it be activated by eccentric or toggle are impeded by the great disadvantage that, as a result of the laterally-situated drive, the top shoe retains a relatively large longitudinal extent and accordingly must be very heavy in order to acquire the necessary flexural stiffness. The large mass brought about in that way increases the power requirements, limits the operating speed, involves more expensive machine parts, and also increases the space occupied by the punching device.

The object of the invention is to provide a punching device of the kind referred to initially which has the advantages of the stationary bottom shoe and displaced top shoe but which on the other hand is much more compact and consequently can be of lighter construction whereby not only a economies in energy are obtained and lower costs of manufacture, but in addition, operating speeds can be considerably increased and also the noise level can be reduced.

This is achieved in an arrangement wherein the bottom shoe is stationary and the top shoe is moved, and the impulsion means for the top shoe is located between the upper shoe and a yoke which is connected with the fixed bottom shoe through prestressed tie rods.

Thus, instead of arranging the drive laterally adjacent to top and bottom shoes, as has always been the case hitherto with moving top shoe, the drive is provided above the top shoe and beneath a stationary yoke connected with the stationary bottom shoe, so that it is no longer necessary to construct this upper bed to be very rigid and therefore heavy because of the laterally-acting driving forces; rather, in virtue of the driving forces acting within the area of the top shoe itself, a relatively light construction can be realized, so that no longer, as hitherto, must the heavy actuating levers also be moved in addition to the heavy punching shoe, which is conducive to considerable vibrations in the bedplate, but practically speaking it is only the top shoe alone which is moved whereby this top shoe is even of a quite considerably lesser weight. The masses to be displaced are therefore quite decisively smaller, whereby not only do vibrations in the bedplate come to be significantly less, but the entire construction is moderate in price and much more compact.

The punching device according to the invention may be realized with various types of drive between top shoe and yoke, in connection with which drives with toggle levers indeed lead in this place to a relatively complicated setup, or instead by providing an eccentric drive which can be particularly advantageously designed in place in such a way that it not only leads to advantageously long "open" periods, but in this case, likewise because of the but small moving masses, it results in a softer punching impact, only slight vibrations in the bedplate and also only slight transmission of sound by air, besides requiring only simple components and making the punching device very compact.

The invention will hereinafter be described in more detail with reference to exemplary embodiments illustrated in the accompanying drawings, in which:

FIGS. 7 and 8 are graphic representations for the explanation of the manner of operation of eccentric drive and toggle drive as well as the ideal operating sequencies of movements to be aimed at.

FIG. 1 shows in diagrammatic form an automatic punching machine for stamping, breaking-away and setting down sheets of paper, cardboard and the like.

Figure 1:
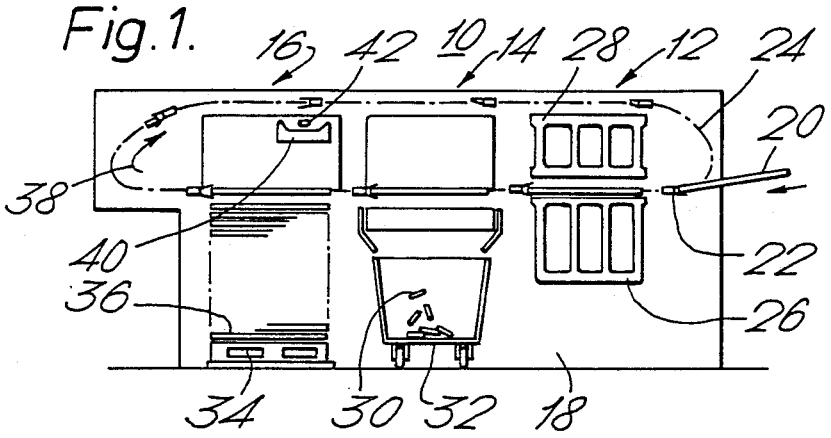
FIG. 1 is a diagrammatic view of an automatic punching machine.

The automatic punching machine 10 comprises a punching device 12, a break-away device 14 and a setting-down device 16 which are supported and enclosed by a shared automatic machine housing 18.

The sheets 20, which are supplied to the automatic punching machine 10 by an arrangement not illustrated in the drawings, are seized at their leading edge by gripper bar arrangements 22 attached to endless chains 24 and are then drawn intermittently through the various stations 12, 14, 16 of the automatic punching machine 10.

In the arrangement illustrated in FIG. 1 the first station comprises the punching device 12 which has a lower platen or bottom shoe 26 and an upper platen or top shoe 28. In the present case the top shoe carries the punch knives and is moved by a drive mechanism, to be described in more detail hereinafter, towards the bottom shoe 26 and can be raised again from the latter and the bottom shoe supports a counter-punch (not shown).

After the sheet has been punched by means of the punch knives and the counter-punch in a cutting operation in such a manner that it retains its form, e.g. through small bridging pieces between the individual punched parts, the pertaining gripper bar 22 carries the sheet forward into the following break-away station 14, which may be provided with break-away tools. At this station, by means of break-away tools which are shown in more detail, the unnecessary parts cut off from the sheet are pushed out downwards, whereby these cut-off parts 30 fall into a bin-like carriage 32 interposed beneath the station.

From the break-away station 14 the sheet arrives at the setting-down station 16 where the sheet is either simply set down, or instead, more advantageously, a separation of the individual useful parts is simultaneously effected, for which purpose use may be made of separating tools, of a kind not shown in more detail. The setting-down station 16 may also include a pallet 34 on which the individual sheets are piled up in the form of a stack 36, so that, after a specific stack height has been reached, the pallet with the stacked sheets can be driven away out of reach of the automatic punching machine 10.

If the sheet is not separated, the clamping device of the gripper 22 is withdrawn from the sheet edge at the setting-down station, but if the sheet is separated there also takes place a separation of the sheet edge held by the gripper bar arrangement 22, so that the gripper first of all runs on still in the direction of the arrow 38 with the separated sheet edge. At a suitable point, e.g. above a further receptacle 40, the grippers of the gripper bar arrangement are then opened and let the sheet edge 42 fall into the receptacle 40. Propelled by the chains 24, the gripper bar arrangement then again arrives at the position where a few sheet 20 is taken up in order to convey this sheet through the three stations 12, 14 and 16.

As will be understood the chains 24 carry a plurality of gripper bars 22, for example there are eight in the present case, so that a plurality of sheets 20 can be processed simultaneously in the various stations.

Figure 2:
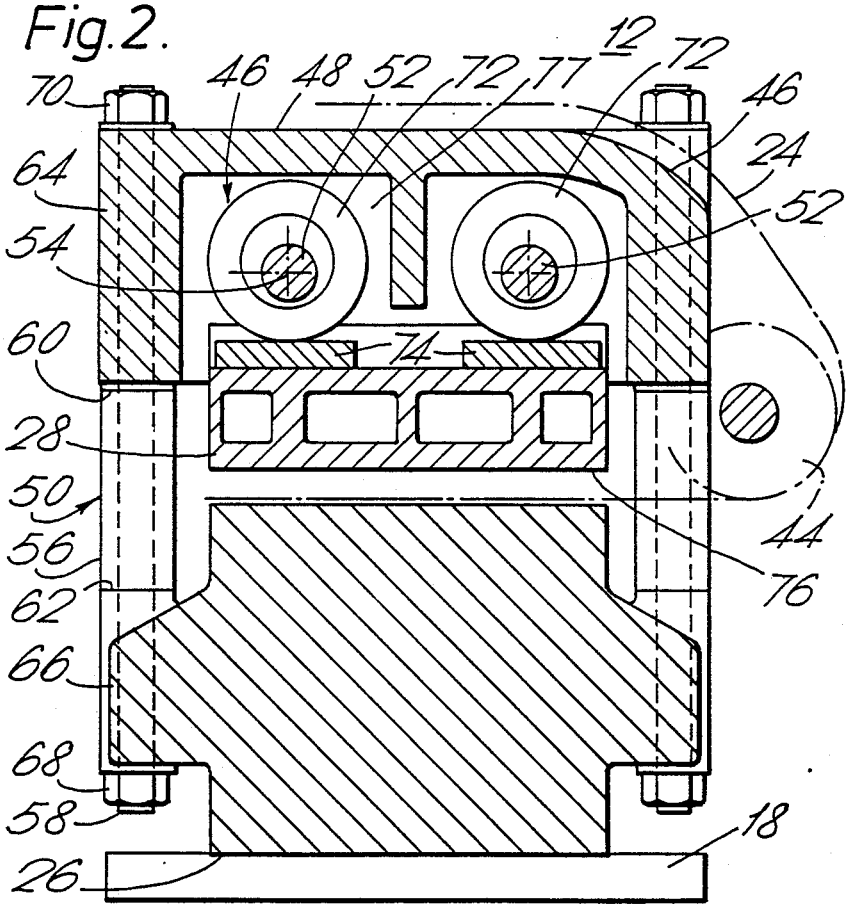
FIG. 2 is a cross section through a punching device with a drive in conformity with the invention for the top shoe involving eccentric shafts.

The punching device 12 of the automatic punching machine 10 is shown in more detail in FIG. 2, the punching device representing but one specific embodiment of the invention. There is again to be seen a bottom shoe 26 and a top shoe 28, and also the chains 24 which are guided around the top shoe 28 by a guideway 46 and guide pulley device 44 in such a way that the gripper bar arrangements (not shown here) carried by the chains 24 can be passed intermittently through between the two shoes 26, 28.

As can be seen, the bottom shoe 26 rests firmly on the housing 18 of the automatic machine whilst the top shoe 28 is impelled by impulsion means 46 arranged between the top shoe 28 and a yoke 48 which is connected with the stationary bottom shoe 26 through prestressed tie rods 50.

In order to bring about a sufficiently-stable mounting of the yoke 48, at least four such tie rods 50 are provided, but with greater widths of sheet even six and more tie rods may be used.

Through the arrangement illustrated, there results a drive for the top shoe 28, which comprises relatively few moving masses, namely, the top shoe 28 itself, which in this case does not need to be larger than the punched surface itself, as well as in addition parts of the impulsion means which sets the top shoe 28 in motion. Owing to this mass, which is considerably reduced relative to constructions hitherto known, the shock load exerted on the automatic machine housing 18 and hence on the foundations of the machine, is considerably reduced, and in addition the power requirements for the drive are much lower. Since, moreover, the drive no longer extends beyond the width of the top shoe, the punching device is also much more compact in relation to other constructions. Also, since the construction of the yoke can be realized by relatively simple engineering methods, the costs of manufacture of the punching device according to the invention are much lower than was formerly the case.

The impulsion means 46 may assume various forms. In this connection reference is made to the following figures.

In FIG. 2 there is represented an eccentric drive which has proved particularly suitable for the punching device according to the invention and under considerations. The drive represented, an eccentric drive, comprises an eccentric shaft 52 supported by the cup-shaped yoke 48 to be rotatable about the axis 54, in a manner not shown in more detail in the drawing. As already stated, the yoke 48 is connected with the bottom shoe, specifically in such manner that the end bearing faces 60 of the yoke rest upon projecting bearing surfaces 62 with interpositioned bushings 56, the firm support being ensured even during the application of punching load, through high-tensile tension rods 58 which are inserted through conformable bores in the yoke flanks 64, the bushings 56 and the projections 66 of the bottom shoe and are put under the desired degree of stress by means of nuts 68, 70.

The two eccentric shafts 52 supported in the yoke 48 are rotated in synchronism with one another by means of a spur-gear system (not shown). At the ends of each of the eccentric shafts 52 is mounted an anti-friction roller 72.

The movable upper top shoe 28 is guided vertically within the yoke 48 by equipment not illustrated and is kept against the rollers 72 by springs (not shown). At the areas of contact between rollers and shoes are hardened steel plates 74 which take up and retransmit to the top shoe 28, the compressive and friction forces exerted by the rollers 72. These steel plates 74 may also be designed wedge-shaped and then be employed for the adjustment of pressure, in that suitable equipment is provided for displacement of the steel plates in relation to the point of support of the rollers 72 in the direction of inclination of the wedge.

It will be appreciated that the drive system is not only very compact but is also of relatively simple construction and transmits the compressive forces to the top shoe 28 at points which are not far removed from the actual punching surface 76, as is the case in the present state of the art where movable top shoes are involved, but within this surface 76 at particularly advantageous points, which allow the top shoe 28 to be given a relatively light frame construction, so that the masses to be moved can be kept very small.

Apart from having to move the top shoe 28, it is necessary to move in addition only the two steel plates 74 up and down, the two rollers 72 also performing this up and down movement in addition to their rotary motion. Thus, the total mass which must be moved to and fro by the drive 46 is exceptionally small; correspondingly small are the power requirements and the recurring impacts to be taken up by the machine frame or the machine bed.

In order to reveal more clearly the advantages of the construction according to the invention, some indications will now be given of the method of operation of punching devices.

The striking of the punch knives on the material to be punched and the mass of the shoe which is set in motion, play a decisive role in the noise development and the ensuing vibrations. In order to keep the vertical speed components as small as possible in the case of eccentric drives, the point of impact of the punch knives on the material to be punched must be as close as possible to the bottom dead centre of the eccentric drive. This can be achieved by making the punching device as rigid as possible, that is by keeping the compression resilience during the punching procedure as small as possible. This can be achieved, on the one hand, by appropriately high prestressing of the four (or more) tie rods 50, and on the other hand, by as little creep as possible between the yoke and the bottom shoe, and also by keeping small the deflections of yoke 48 and bottom shoe 26 through the relatively short spans determined by the projections 66 and the yoke flanks 64.

Moreover, the deflection of the top shoe 28 can be kept small because of the only very short distances between the rollers 72.

Compared with the very light weight of the moving top shoe 28 the weight of the bottom shoe 26 is considerably greater. The bottom shoe is not moved and, in consequence of its very much greater weight compared to the upper shoe, it has to perform only a very slight vertical movement to assimilate the recurring impact of the top shoe 28, i.e. the impact force transmitted to the bedplate is very much less than has formerly been the case.

The reduction of the shock load is so considerable that the use of so-called toggle drives instead of the eccentric drive 46 shown in FIG. 2 is not necessary in most cases. Only in exceptionally critical cases could it be of advantage to provide such a toggle drive in the punching device according to the invention (see FIG. 3). The toggle drive 78 shown in this figure comprises an upper frame portion 80 and a lower frame portion 82, the upper frame portion butting against the yoke 48 and the lower frame portion butting against the top shoe 28. Arranged within both of the frame portions 80, 82 are swivel seats 84 in which are supported toggle levers 88, 90 interconnected by a toggle joint 86. The toggle joint 86 moreover supports a roller 92 on which rolls an elliptic driving wheel 95 rotatable in the direction of the arrow 98 by a driving shaft 94. During this rolling motion the toggle joint 86 is pressed outwards to a variable extent, whereby the two toggle levers 88, 90, the seats 84 and consequently the two frame portions 80, 82 are pressed apart to a variable extent.

As can be appreciated, the toggle drive system is much more complicated in construction than the eccentric shaft drive 77 represented in FIG. 2, and the pressure adjustment is also considerably more complicated. In its favour, the toggle drive has an essentially flatter shape of stroke at the reversal point, as can be seen from a comparison of the stroke movement for eccentric drive and toggle drive shown in FIG. 7. Whereas with the eccentric drive the periodic curve of the stroke movement is essentially sinusoidal, the usual toggle drive exhibits a stroke curve which is substantially flatter at the reversing points of the movement than a sine curve. One result of this is that the impact loading is more favourable, indeed reduces the time available for the passage of the gripper bar. Assuming that the minimum lift necessary for the passage of the gripper bars is half the stroke length, there results the specified time differences for the passage of the gripper bars can conflict with the requirement for the greatest possible speed of passage of the sheet since, even at high speeds, the sheets of board must be forwarded through the machines as smoothly as possible. This is due to the fact that the sheets, after the punching operation, are connected with one another only by very slender webs. It is therefore necessary, even at high operating speeds, that the sheets are subject to only limited rates of acceleration during the intermittent forwarding. This means that the times available for the forwarding of the sheets from one work station to the next must endure as long as possible, which again implies the longest possible "open" period for the punching shoes.

Figure 7:
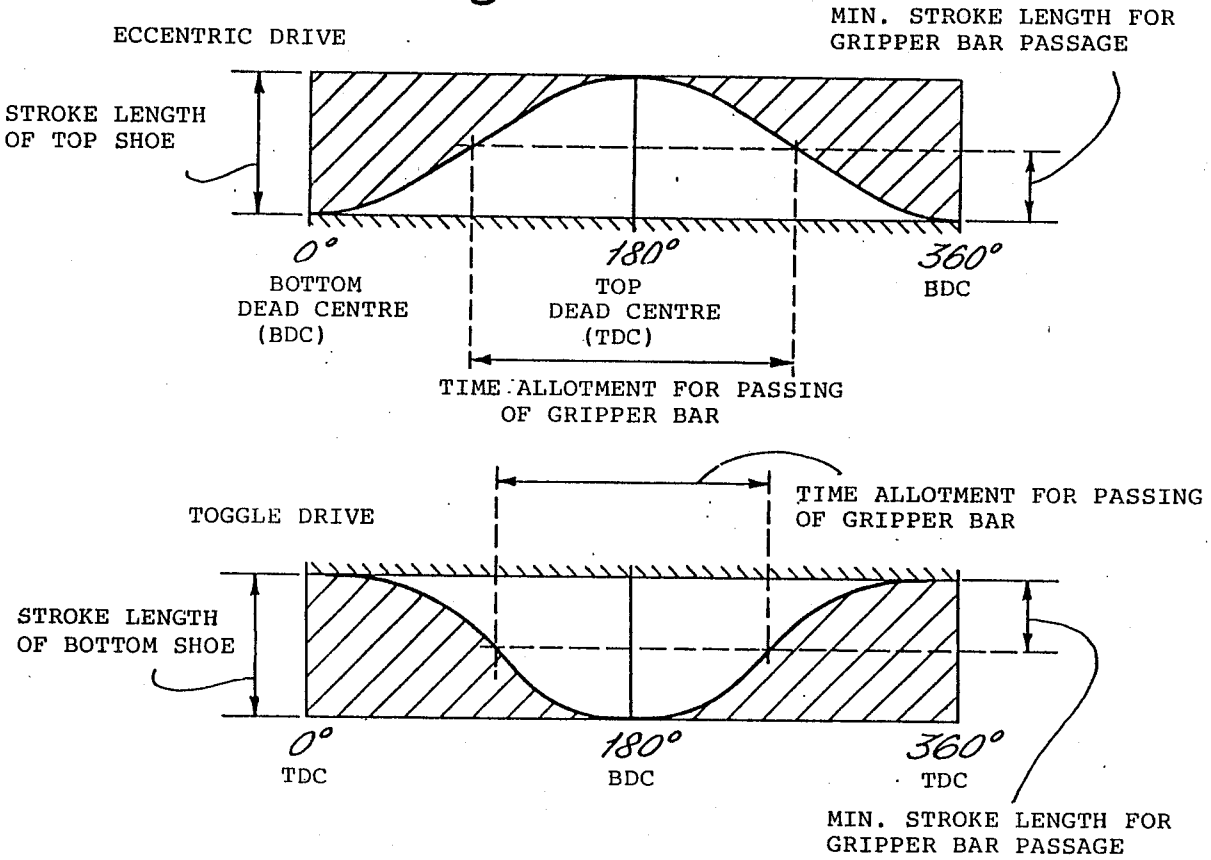
Figure 8:
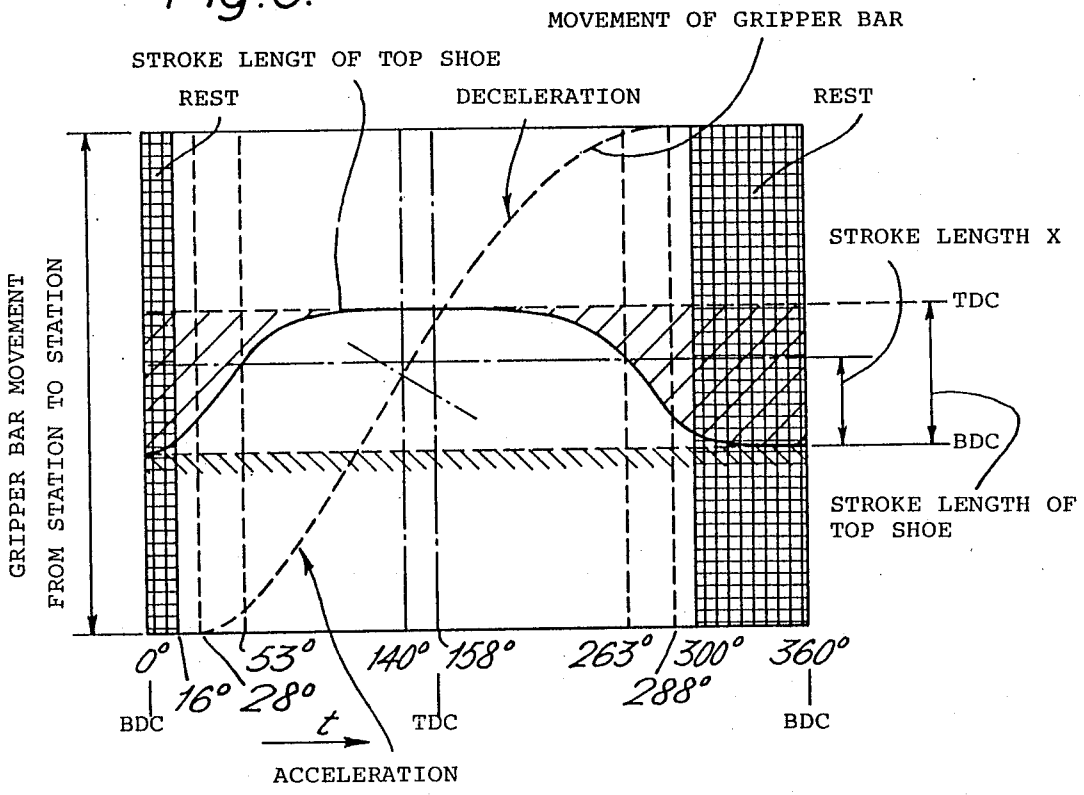

In the diagrams of FIG. 7 and 8 a machine cycle amounts to 360° (i.e. one revolution). In the case of the eccentric drive the time allotment for the rest period amounts in the most favourable case to 72°, whilst the remaining 288° are available for the movement of the gripper bar. In the case of the toggle drive, as 130° are required for the rest period, only 230° are available for the movement sequence. In the case of punching machines of average size with a speed of 7000 sheets per hour, maximum acceleration rates of 5.3g then arise (1 g -acceleration due to gravity), whilst in the case of toggle machines the acceleration rates are of the order of 8.3 g, and thus considerably greater.

FIG. 8 shows the relationships in the case of a drive at optimum performance. The bottom dead centre of the stroke movement is taken as 0°. Departing from this bottom dead centre, there is a rapid upward lift of the top shoe or platen and at 16° the chains and therewith the gripper bars begin to move. At 28° the gripper bars, which were previously held back by stop devices (not shown), are completely free, so that at this point of time the top platen with the punch knives must already have carried out so much of the stroke that the punched sheet can be further forwarded without the risk of being caught up at the punch knives or at any ejector devices arranged between them in certain cases. At 53° the next gripper bar can pass between the platens, at 140° the maximum speed of the gripper bar is reached and the acceleration of the gripper bars run through 0, and deceleration begins. At 158° the top dead centre of the movable platen is reached and it slowly begins its downward stroke. AT 263° the gripper bar must have left the platen clearance; in this region rapid downward movement of the platen takes place. At 288° the gripper bar is seized by the aligning mechanism already briefly mentioned, at 300° the gripper bar movement is ended, the downward movement of the platen slows down and is gradually stopped level at the bottom dead centre.

This stroke curve cannot be realized with the eccentric system illustrated in FIG. 2, nor with conventional toggle drives driven by circular discs. The toggle drive shown in FIG. 3 with elliptical cam 96 may however, by suitable selection of the elliptical cam 96, be so constructed that a close approximation to optimum relationships is possible.

Figure 4:
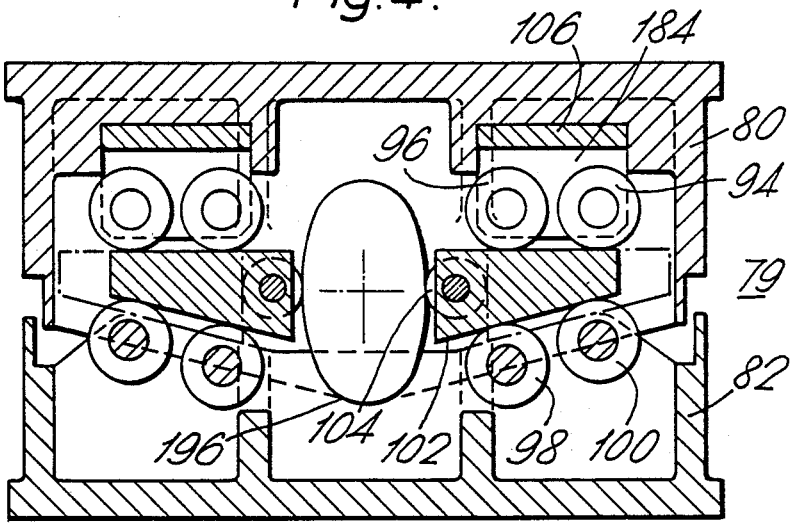
FIG. 4 shows yet another specific embodiment comprising a wedge-form transmission with cam-type drive.
Figure 5:
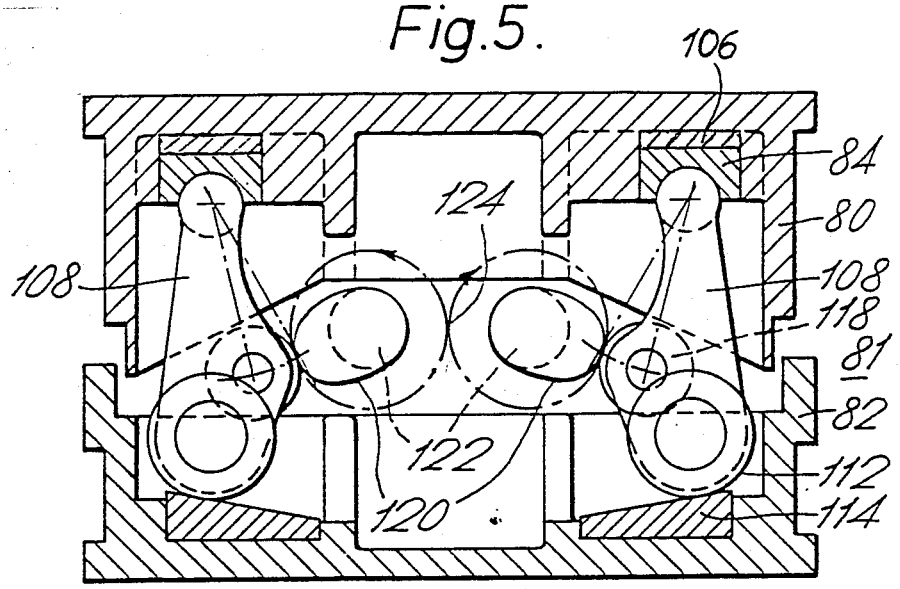
FIG. 5 shows a further specific embodiment comprising a rocking lever transmission with cam drive.
Figure 6:
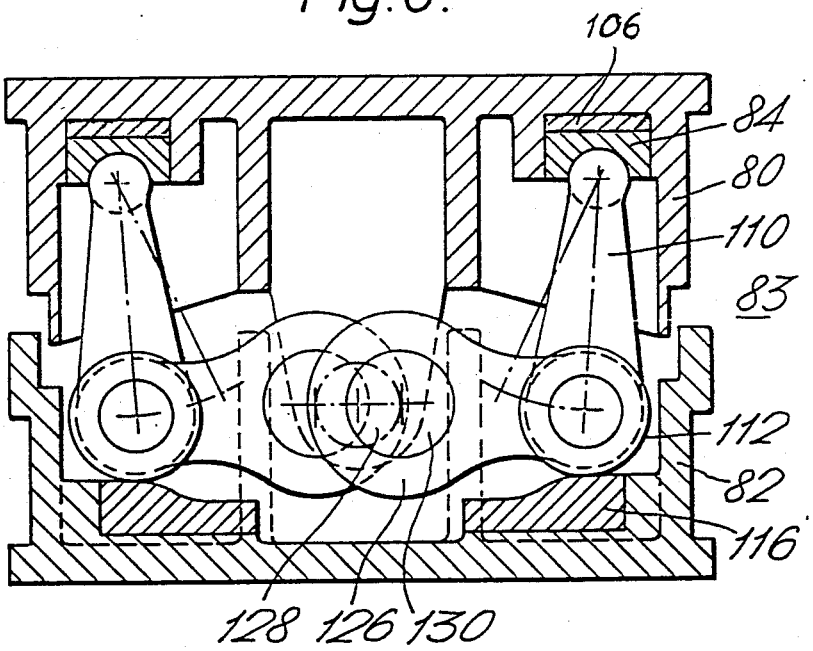
FIG. 6 illustrates yet another specific embodiment comprising a rocking lever transmission with crank drive.

Other systems which also offer an approximation to ideal relationships are shown in the further FIGS. 4, 5 and 6.

Thus FIG. 4 in an illustration similar to that of FIG. 3 again shows drive means for the top shoe 28 of the punching device according to the invention, this drive, however, comprising a wedge-type key transmission with cam drive. In this case also, as in the embodiment illustrated in FIG. 3, there is an upper frame portion 80 and a lower frame portion 82, again for example in the form of shaped castings, the upper portion 80 including a cage 184 for rollers 94, 96 instead of the seat 84. The bottom frame portion directly supports further rollers 98, 100, a wedge-formed part 102 being shiftable to and fro between the rollers 94, 96 of the upper portion 80 connected with the top shoe and the rollers 98, 100 of the lower portion 82 connected with the bottom shoe specifically through the action of a disc cam 196 which is in rolling contact with a roller 104 carried by the wedge-formed part 102.

It should be mentioned that the cage 184 may have a wedge surface, in order to make adjustment of the punching possible in a simple manner, in this case by displacement of the cage 184 in a direction normal to the plane of the drawing. An additional wedge adjustment 106 may also be provided between the cage 184 and the upper frame portion 80 in order to obtain this possibility of adjustment. A similar wedge adjustment may also be arranged in the toggle transmission according to FIG. 3.

FIGS. 5 and 6 show two different further specific embodiments for a drive suited to the invention, it being a question of two different rocking lever transmissions, one with cam drive (FIG. 5) and the other with crank drive (FIG. 6). Here again in each case are an upper frame portion 80 and a lower frame portion 82, the upper frame portion 80 having a seat 84 just as in the case of FIG. 3 to receive the rocking lever 108 or 110. The rocking lever carries at its other end a roller 112 which can roll upon a wedge-formed part 114 (in the drive according to FIG. 5) or upon a curved track part 116 (in the drive according to FIG. 6). The rocking lever 108 also carries another roller 118 on which a cam plate 120 slides and thus swings the rocking lever 108 about the hinge axis formed by the seat 84, whereby the roller 112 slides on the wedge-formed part and in doing so displaces the upper frame portion 80 relative to the lower portion 82. The two rocking levers 108 which can be perceived in FIG. 5 have each an appertaining cam plate 120, the cam plates 120 being rigidly supported on shafts 122, which in their term can be driven in synchronism with one another, for example by means of gear drives 124.

In the case of the specific embodiments represented in FIG. 6, the rocking lever 110 can be displaced to and fro along the curved track part 116 by a crank 126 which in turn can be driven by the offset crank drive 130 of a crankshaft 128.

Figure 3:
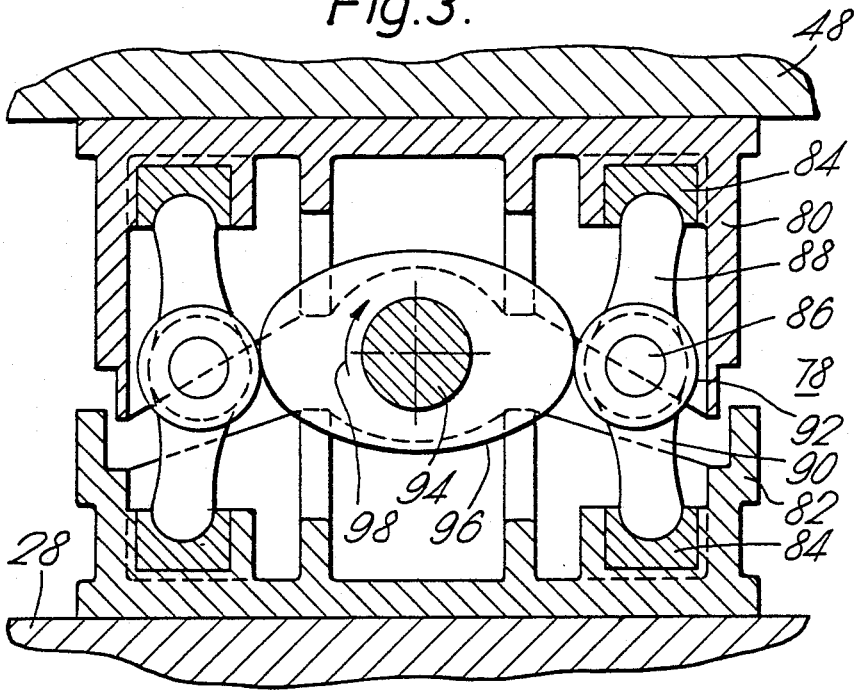
FIG. 3 shows another specific embodiment of a top shoe drive comprising a toggle system with cam-type drive.

Even in the case of the specific embodiments of FIGS. 5 and 6 adjustment of the punching pressure can be effected in the manner already described with reference to FIGS. 3 and 4.

Compared with hitherto-known drive for the top shoe, all of the specific embodiments represented in FIGS. 2 to 6 reduce to about ⅓ the masses to be moved to and fro of the top shoe.

Correspondingly smaller are the power requirements and also the recurring shock loads to be taken up by the machine bedplate, which loads, in consequence of the arrangements of FIGS. 3 to 6 —allowing for more complicated arrangements —can be reduced still further by bringing motional relationships close to the ideal operating form of FIG. 8, so that, apart from extreme cases, e.g. setting up the machine on upper floors, anti-vibration precautions normally always required between the machine and the bedplate on which it is set up may be dispensed with.

Apart from this advantage there is the further advantage of the more compact form of the machine which leads to not only economy in floorspace but also to a lower cost of manufacture of the machine.

We claim:

1. A punching device for automatic punching machines for the punching of sheet material, comprising a bottom shoe and a top shoe, wherein one shoe supports punch knives and the other shoe supports a counter-punch, said bottom shoe being stationary and said top shoe being movable to and fro normal to the plane of the counter-punch, impulsion means for moving said top shoe comprising at least one rocking lever, a roller carried by one end of said rocking lever, track means positioned beneath said roller and along which said roller rolls, and drive means for activating said rocking lever, said impulsion means for the top shoe located between the top shoe and a yoke which is connected with the stationary bottom shoe through prestressed tie rods, and a gripper bar arrangement for intermittent forwarding of said sheet material between said bottom and top shoes for punching.

2. A punching device according to claim 1, in which there are four tie rods.

3. A punching device according to claim 1, in which the impulsion means further comprises an upper frame portion which is connected with the yoke or is integral therewith, and a lower frame portion which is connected with the top shoe or is integral therewith, the upper and lower frame portions being displaceable to and fro relative to each other by said drive means.

4. A punching device according to claim 3, wherein said drive means comprises a crank drive.

5. A punching device according to claim 3, wherein said drive means comprises a cam drive.

6. A device according to claim 1 in which the moving mass of the top shoe, including the masses raised and lowered of said drive means is many times less than the stationary mass of the bottom shoe.

7. A device according to claim 1 further comprising wedge-shaped punching-pressure-adjusting devices.

8. A device according to claim 1, wherein said track means is a wedge-shaped track.

9. A device according to claim 1, wherein said track means is a curved track.

10. A punching device for automatic punching machines adapted for punching sheet material comprising: a movable top shoe and stationary bottom shoe with one shoe supporting punch knives and the other shoe supporting a counter-punch; a yoke positioned over the top shoe and connected with the bottom shoe through prestressed tie rods; an upper frame portion and a lower frame portion, said upper frame portion abutting against said yoke and said lower frame portion abutting against said top shoe; impulsion means for said top shoe located between said upper and lower frame portions, said impulsion means comprising at least one rocking lever one end of which is received within a seat carried by said upper frame portion, a roller carried by the other end of said rocking lever, track means position beneath said roller, and drive means for activating said rocking lever, whereby said rocking lever is activated by said drive means, said roller rolls along said track means; and gripper means for intermittent forwarding between said top and bottom shoes of sheet material for punching.

11. A device according to claim 10, wherein said drive means is a cam plate.

12. A device according to claim 10 wherein said drive means is a crank drive.

13. A device according to claim 10, wherein said track means is a wedge-shaped track.

14. A device according to claim 10, wherein said track means is a curved track.

* * * * *